US009802071B2

(12) United States Patent
Chen

(10) Patent No.: US 9,802,071 B2
(45) Date of Patent: Oct. 31, 2017

(54) VALVE CONTROL DEVICE FOR FIRE-EXTINGUISHING PIPING

(71) Applicant: PROTECTOR SAFETY IND., LTD., Taoyuan County (TW)

(72) Inventor: Jung-Wen Chen, Taoyuan County (TW)

(73) Assignee: PROTECTOR SAFETY IND., LTD., Taoyuan (TW)

( * ) Notice: Subject to any disclaimer, the term of this patent is extended or adjusted under 35 U.S.C. 154(b) by 319 days.

(21) Appl. No.: 14/745,767

(22) Filed: Jun. 22, 2015

(65) Prior Publication Data

US 2016/0303411 A1 Oct. 20, 2016

(30) Foreign Application Priority Data

Apr. 20, 2015 (TW) ..... 104112517 A

(51) Int. Cl.
*A62C 35/68* (2006.01)

(52) U.S. Cl.
CPC ..... *A62C 35/68* (2013.01)

(58) Field of Classification Search
USPC ..... 251/33; 169/16–20
See application file for complete search history.

(56) References Cited

U.S. PATENT DOCUMENTS 2,722,234 A * 11/1955 MacGeorge ..... F15B 13/0402 137/625.6
5,236,049 A * 8/1993 Asselin ..... A62C 35/64 169/17
2007/0221388 A1* 9/2007 Johnson ..... A62C 35/58 169/16

* cited by examiner

*Primary Examiner* — Jessica Cahill
*Assistant Examiner* — Daphne M Barry
(74) *Attorney, Agent, or Firm* — Chun-Ming Shih

(57) ABSTRACT

A valve control device for fire-extinguishing piping includes a deluge valve whose water-pressure control chamber is connected to a water inlet manifold and a water outlet manifold. The water outlet manifold has an adjustable-pressure valve, a constant-pressure valve, and a switch valve. The water inlet manifold guides fire-extinguishing water to the water-pressure control chamber for pressure accumulation. The water outlet manifold guides the fire-extinguishing water in the water-pressure control chamber to the water outlet passage. The water outlet manifold controls when the fire-extinguishing water is discharged using the switch valve. The constant-pressure valve performs first water-pressure control on the fire-extinguishing water in the water-pressure control chamber and in the water outlet manifold. The adjustable-pressure valve performs second water-pressure control on the fire-extinguishing water in the water-pressure control chamber and in the water outlet manifold, thereby preventing pressure drop, fluid hammer, and water outage during a power failure.

8 Claims, 4 Drawing Sheets

VALVE CONTROL DEVICE FOR FIRE-EXTINGUISHING PIPING

BACKGROUND OF THE INVENTION

1. Technical Field

The present invention relates to water-pressure controls used in fire-extinguishing piping, and more particularly to a valve control device for fire-extinguishing piping.

2. Description of Related Art

It is well known that fire-extinguishing piping is required by fire services acts in many countries to be provided in all buildings and communal facilities such as bridges and tunnels. Typically, fire-extinguishing piping comprises a water pump and plural sprinkler heads that are connected by pipelines. The water pump pressurizes water so as to deliver fire-extinguishing water to the sprinkler heads for sprinkling water and extinguishing fire. In addition, a deluge valve is installed on the pipeline between the water pump and the sprinkler heads to control the fire-extinguishing water pressurized by the water pump with a preset pressure and control the pressure for opening the valve and supply water, thereby delivering the fire-extinguishing water to the plural sprinkler heads for their synchronous sprinkling water and extinguishing fire.

However, when the fire-extinguishing piping is installed in a tunnel, the distance between the deluge valve and the endmost sprinkler head increases with the length of the tunnel and tends to be too large to remain enough water pressure at the sprinkler heads near the terminal of the fire-extinguishing piping. As a result, the fire-extinguishing capacity at the terminal of the fire-extinguishing piping is degraded.

It is also known that the fire-extinguishing water in fire-extinguishing piping flows to sprinkler heads through the deluge valve. In such a deluge valve, there is a valve port configured to control water flow. The valve port can be open or closed by operating a valve plug that is driven by water pressure. Since the deluge valve contains therein a water-pressure control chamber, and the deluge valve has the valve plug between its water inlet passage and water outlet passage, while the water inlet passage and the water outlet passage are connected to the water-pressure control chamber through respective manifolds, it is possible to use the water pressure within the water-pressure control chamber to drive the valve plug to open and close the valve. Therefore, when the pressure accumulated in water-pressure control chamber makes the fire-extinguishing water flow to the water outlet passage through the manifold, fluid hammer tends to happen in the manifold. This can cause annoying noise, and in some case may damage the manifold over time.

Generally, a deluge valve installed on the fire-extinguishing piping has its water inlet passage or water outlet passage equipped with a switch valve for opening and closing the fire-extinguishing piping. This switch valve generally comprises a manual valve and a solenoid valve. The solenoid valve can only work to open the valve when electrified and activated by a flame sensor. When a fire breaks out in a tunnel, a power failure is likely to come as a consequence. Once this power failure happens, the solenoid valve is closed and the water supply from the fire-extinguishing piping is stopped. The water outage in turn makes the sprinkler heads useless.

Additionally, when flame sensors in a tunnel detect flame or smoke, they activate fire-extinguishing piping to sprinkle at the connected sprinkler heads. Since the sprinkling operation usually starts without providing warning, road users and drivers in the tunnel may be startled, or in some other cases, water may hit people and cars in the tunnel and cause accidents.

These shortcomings relates to the prior art need to be addressed.

SUMMARY OF THE INVENTION

In view of this, the present invention has an objective to prevent problems about pressure drop, fluid hammer, water outage during a power failure, and sprinkling without warning in fire-extinguishing piping by providing a valve control device.

For achieving the foregoing objective, the present invention implements the following technical scheme.

A valve control device for fire-extinguishing piping comprises:

a deluge valve defining therein a valve port as well as a water inlet passage and a water outlet passage that are both communicated with the valve port, the deluge valve also defining therein a water-pressure control chamber that is equipped with a valve plug for removably closing the valve port, and the deluge valve having a water inlet manifold that is communicated with the water inlet passage and the water-pressure control chamber, and a water outlet manifold that is communicated with the water outlet passage and the water-pressure control chamber;

an adjustable-pressure valve being installed on the water outlet manifold;

a constant-pressure valve being installed on the water outlet manifold and arranged between the water-pressure control chamber and the adjustable-pressure valve; and a switch valve being installed on the water outlet manifold and arranged between the water-pressure control chamber and the constant-pressure valve, wherein, the water inlet manifold guides fire-extinguishing water in the water inlet passage to enter the water-pressure control chamber for pressure accumulation, and the water outlet manifold guides the fire-extinguishing water in the water-pressure control chamber to be discharged into the water outlet passage that uses the switch valve to control when the fire-extinguishing water is discharged, and wherein the constant-pressure valve performs first water-pressure control on the fire-extinguishing water in the water-pressure control chamber and in the water outlet manifold, and the adjustable-pressure valve performs second water-pressure control on the fire-extinguishing water in the water-pressure control chamber and in the water outlet manifold.

With the technical means described above, the present invention provides the following advantages:

1. The constant-pressure valve and the adjustable-pressure valve perform water-pressure control on the fire-extinguishing water in the water-pressure control chamber and in the water outlet manifold, so as to control the flow of the fire-extinguishing water passing through the valve port, and in turn adjust the water pressure of the fire-extinguishing water coming out from the water outlet passage. This is effective in preventing decrease of water pressure at the terminal of the fire-extinguishing piping.

2. The constant-pressure valve controls the fire-extinguishing water in the water-pressure control chamber, so as to prevent fluid hammer when the fire-extinguishing water flows to the water outlet passage through the water outlet manifold.

3. The electric valve remains open regardless a power failure, so as to allow the fire-extinguishing piping keep supplying water to extinguish fire during the power failure, thereby ensuring the effectiveness of the sprinkler heads.

4. The inlet needle valve and the outlet needle valve perform flow control on the fire-extinguishing water in the water-pressure control chamber, so as to make the valve plug progressively open the valve port with longer time, which leads to incremental sprinkling of the fire-extinguishing water from the sprinkler heads, thereby giving time for the road users and drivers in the tunnel to notice the sprinkling operation and helping to prevent accidents related to sudden sprinkling.

The invention as well as a preferred mode of use, further objectives and advantages thereof will be best understood by reference to the following detailed description of illustrative embodiments when read in conjunction with the accompanying drawings.

DETAILED DESCRIPTION OF THE INVENTION

Figure 1:
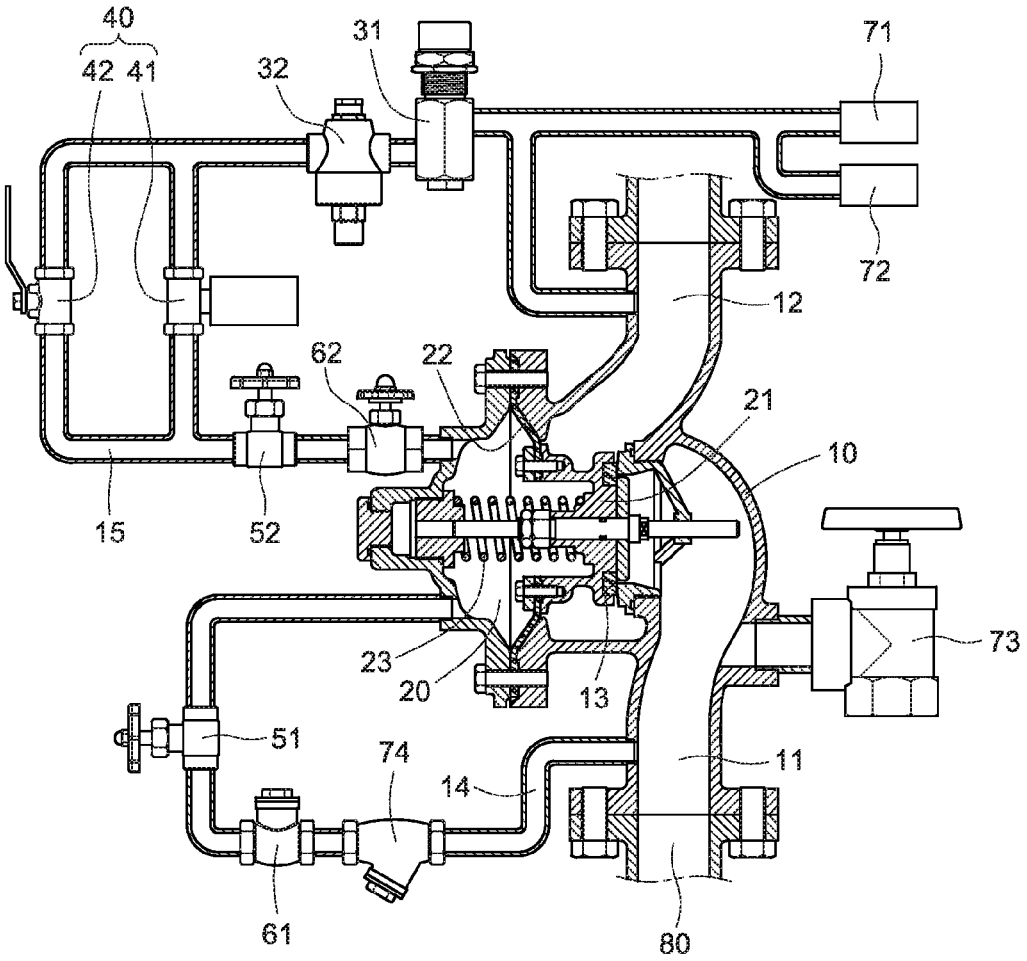
FIG. 1 is a structural drawing of one preferred embodiment of the present invention.

Referring to FIG. 1 first, according to the present invention, a valve control device for fire-extinguishing piping comprises a deluge valve 10, an adjustable-pressure valve 31, a constant-pressure valve 32, and a switch valve 40.

The deluge valve 10 may be molded form metal and contains therein a water inlet passage 11 and a water outlet passage 12 that are communicated with each other. The water inlet passage 11 and the water outlet passage 12 are connected to a pipeline 80, respectively. A valve port 13 is formed between the water inlet passage 11 and the water outlet passage 12. In the pipeline 80, fire-extinguishing water flows form the water inlet passage 11 and passes through the valve port 13 before getting drained at the water outlet passage 12.

The deluge valve 10 is equipped with a movable valve plug 21 for opening and closing the valve port 13. The valve plug 21 is fixed to a valve diaphragm 22. The valve diaphragm 22 is fixed in the deluge valve 10. A water-pressure control chamber 20 is formed between the valve diaphragm 22 and the deluge valve 10. The water-pressure control chamber 20 is communicated with the water inlet passage 11 through a water inlet manifold 14, and is communicated with the water outlet passage 12 through a water outlet manifold 15. The water inlet manifold 14 serves to guide the fire-extinguishing water in the water inlet passage 11 to enter the water-pressure control chamber 20 for pressure accumulation. The water outlet manifold 15 serves to guide the fire-extinguishing water in the water-pressure control chamber 20 to flow into the water outlet passage 12. With the water inlet manifold 14 and the water outlet manifold 15, the fire-extinguishing water is guided into and out of the water-pressure control chamber 20, so as to change the water pressure within the water-pressure control chamber 20. The water-pressure control chamber 20 is also equipped with a compression spring 23. When the sum of the water pressure in the water-pressure control chamber 20 and the spring pressure of the compression spring 23 is greater than the water pressure within the water inlet pipeline 11, the valve plug 21 is driven to close the valve port 13. On the contrary, when the sum of the water pressure in the water-pressure control chamber 20 and the spring pressure of the compression spring 23 is smaller than the water pressure within the water inlet pipeline 11, the valve plug 21 is driven to open the valve port 13.

The adjustable-pressure valve 31 and the constant-pressure valve 32 are installed on the water outlet manifold 15, respectively. The constant-pressure valve 32 is located between the water-pressure control chamber 20 and the adjustable-pressure valve 31. The constant-pressure valve 32 performs first water-pressure control on the fire-extinguishing water in the water-pressure control chamber 20 and in the water outlet manifold 15. The adjustable-pressure valve 31 performs second water-pressure control on the fire-extinguishing water in the water-pressure control chamber 20 and in the water outlet manifold 15. In the embodiment, the pressure of the second water-pressure control performed by the adjustable-pressure valve 31 is smaller than the pressure of the first water-pressure control performed by the constant-pressure valve 32. Thereby, the adjustable-pressure valve 31 and the constant-pressure valve 32 control the water pressure in the water-pressure control chamber 20 and the water pressure in the water outlet manifold 15, so as to control the flow of the fire-extinguishing water passing through the valve port 13, and in turn regulate the water pressure of the fire-extinguishing water flowing out from the water outlet passage 12. In addition, when the switch valve 40 is open, the fire-extinguishing water starts to flow in the water outlet manifold 15. At this time, the constant-pressure valve 32 serves to slow down the fire-extinguishing water, thereby preventing fluid hammer caused by the fire-extinguishing water in the water outlet manifold 15, improving the service life of the water outlet manifold 15, and eliminating noise coming with fluid hammer.

The switch valve 40 in the present embodiment is installed on the water outlet manifold 15 and arranged between the water-pressure control chamber 20 and the constant-pressure valve 32. The switch valve 40 serves to control when the fire-extinguishing water is discharged from the water outlet manifold 15, so as to open and close the valve port 13.

Particularly, the switch valve 40 in the present embodiment comprises an electric valve 41. The electric valve 41 may be an electric ball valve or a solenoid valve. Where the electric valve 41 is a solenoid valve, it has to be one that does not return to its closed position just because of a sudden power failure. On the other hand, whether the electric valve 41 is an electric ball valve or a solenoid valve, it must open and supply water whenever it is electrified, and remain open and keep supply water during the fire-extinguishing operation when a power failure happens, so as to prevent the sprinkler heads become ineffective for water outage caused by a power failure that makes the valve closed. For example, an electric ball valve is a suitable option since it is able to remain the valve open even in case of a sudden power failure and in turn allow the sprinkler heads to keep sprinkling water and extinguishing fire.

In one embodiment, the switch valve 40 further comprises a manual valve 42. The manual valve 42 is connected in parallel with the electric valve 41 while installed on the water outlet manifold 15. An operator can manually open the water outlet manifold 15 when there is a need to test the fire-extinguishing piping or when the electric valve 41 has any fault.

As shown, the water inlet manifold 14 is equipped with an inlet needle valve 51, and the water outlet manifold 15 is equipped with an outlet needle valve 52. The inlet needle valve 51 controls the flow of the fire-extinguishing water running from the water inlet passage 11 into the water-pressure control chamber 20. The outlet needle valve 52 controls the flow of the fire-extinguishing water discharged from the water-pressure control chamber 20 to the water outlet passage 12. With the inlet needle valve 51 and the outlet needle valve 52 that control the flows in and out the water-pressure control chamber 20, the water-pressure control chamber 20 such operates that it progressively opens the valve port 13 with longer time, which leads to incremental sprinkling of the fire-extinguishing water from the sprinkler heads, thereby giving time for people around the sprinkler heads to notice and properly react to the sprinkling operation and helping to prevent accidents related to sudden sprinkling.

The water inlet manifold 14 is further provided with a check valve 61. The check valve 61 is arranged between the water inlet passage 11 and the inlet needle valve 51. The check valve 61 helps to prevent the fire-extinguishing water in the water-pressure control chamber 20 and in the water outlet manifold 15 from flowing back to the water inlet pipeline 11 through the water inlet manifold 14, thereby preventing native pressure from building up in the water-pressure control chamber 20 and making the valve port 13 open.

The water outlet manifold 15 is further provided with a stop valve 62. The stop valve 62 is arranged between the water-pressure control chamber 20 and the outlet needle valve 52. When the water outlet manifold 15 fails to close because of, for example, failure of the electric valve 41 or of the manual valve 42, it is still possible to close the water outlet manifold 15 by operating the stop valve 62, so as to prevent native pressure from building up in the water-pressure control chamber 20 and making the valve port 13 open.

The water outlet manifold 15 further has a pressure switch 71 and a self-acting discharge valve 72. The pressure switch 71 and the self-acting discharge valve 72 are arranged between the adjustable-pressure valve 31 and the water outlet passage 12. When the switch valve 40 closes the water outlet manifold 15, the pressure switch 71 works to determine whether there is water remained in the water outlet manifold 15. If there is remaining water, the self-acting discharge valve 72 is activated to discharge the water.

Moreover, the water inlet passage 11 is connected to a discharge valve 73. For overhaul of the deluge valve 10, the discharge valve 73 discharges the fire-extinguishing water remained in the water inlet passage 11. The water inlet manifold 14 is connected to a filter 74. The filter 74 filters the fire-extinguishing water running from the water inlet passage 11 into the water inlet manifold 14, so as to prevent the water inlet manifold 14 and the water outlet manifold 15 from blockage due to impurities carried by the fire-extinguishing water.

Figure 2:
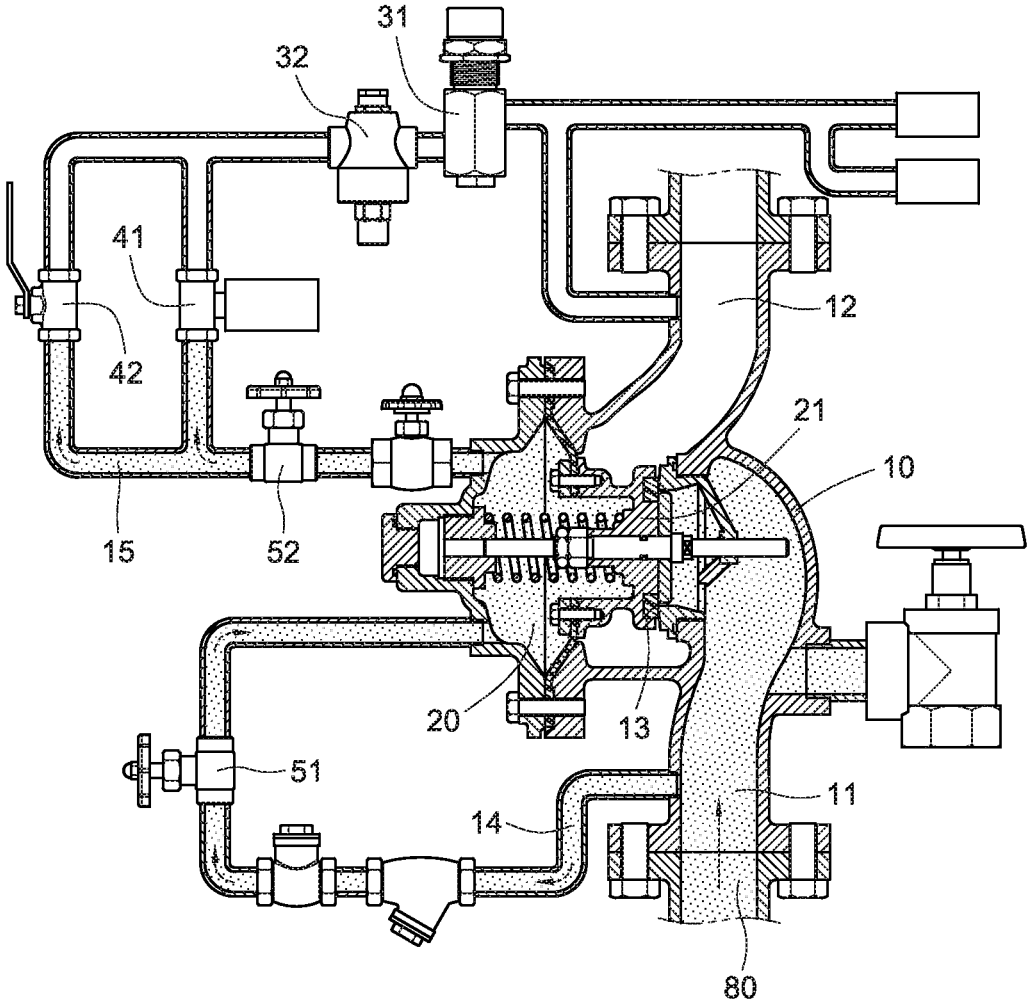
FIG. 2 through FIG. 4 illustrate operation of the embodiment of the present invention.
Figure 3:
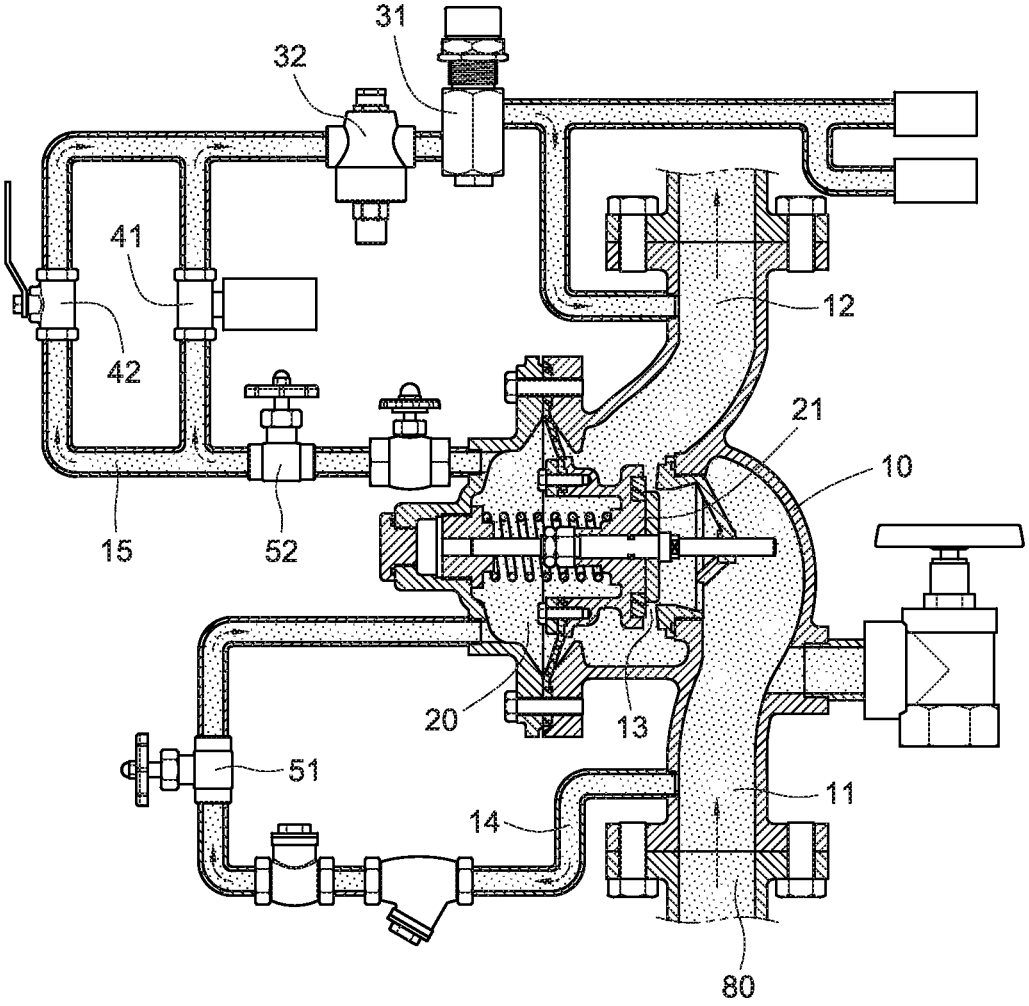
Figure 4:
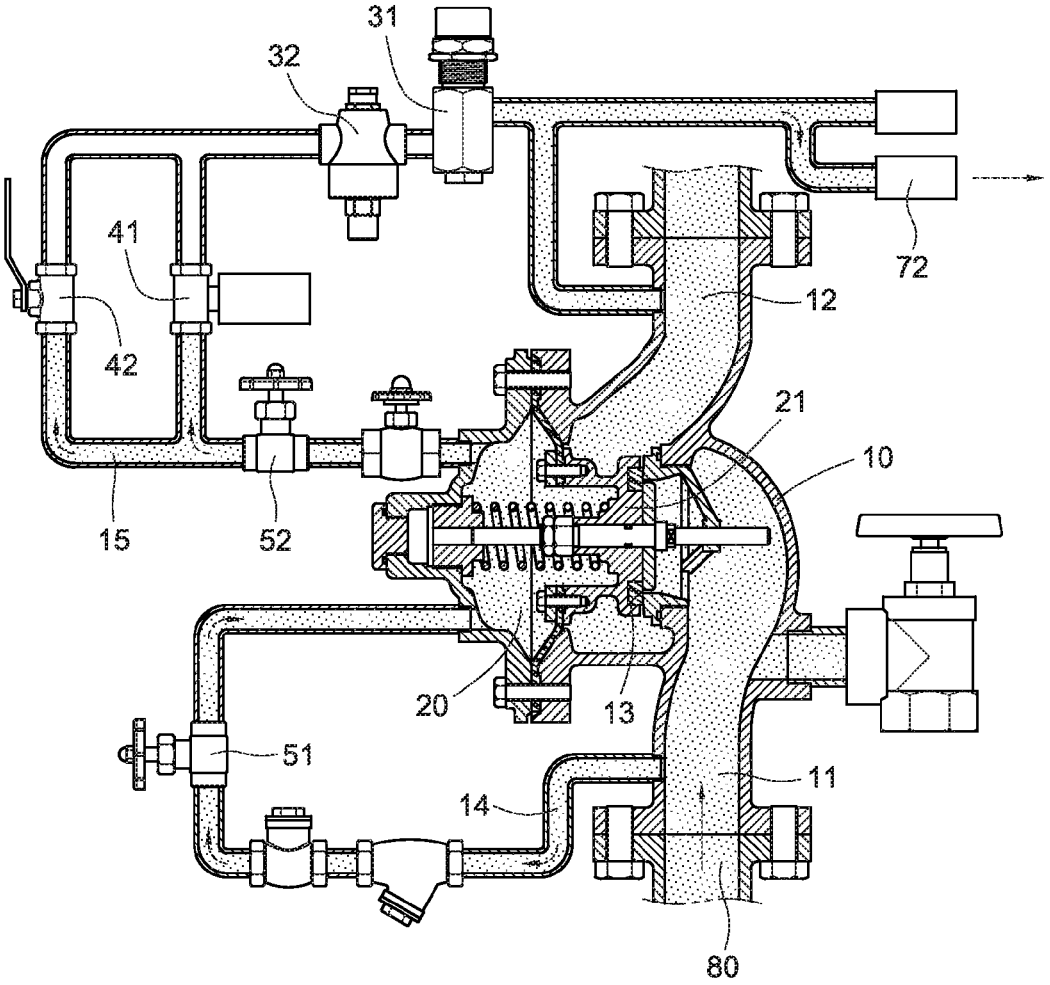

With the foregoing configuration, referring to the operation shown in FIG. 2 through FIG. 4, when the fire-extinguishing water flows into the water inlet pipeline 11 through the pipeline 80 (as shown in FIG. 2), the fire-extinguishing water in the water inlet pipeline 11 flows into the water-pressure control chamber 20 and the water outlet manifold 15 through the water inlet manifold 14. Since the electric valve 41 and the manual valve 42 on the water outlet manifold 15 are not open yet, the fire-extinguishing water flowing into the water-pressure control chamber 20 starts to accumulate pressure until its pressure is equal to the water pressure of the fire-extinguishing water in the water inlet pipeline 11. When the sum of the water pressure in the water-pressure control chamber 20 and the spring pressure of the compression spring 23 is greater than the water pressure in the water inlet pipeline 11, the valve plug 21 is driven to close the valve port 13.

Now please refer to FIG. 3. When the electric valve 41 or the manual valve 42 is open, the fire-extinguishing water in the water outlet manifold 15 is allowed to flow toward the constant-pressure valve 32, making the water pressure in the water-pressure control chamber 20 decrease. When the sum of the water pressure in the water-pressure control chamber 20 and the spring pressure of the compression spring 23 is smaller than the water pressure in the water inlet pipeline 11, the valve plug 21 is driven to open the valve port 13. With the adjustable-pressure valve 31 and the constant-pressure valve 32 that perform water-pressure control on the fire-extinguishing water in the water-pressure control chamber 20 and in the water outlet manifold 15, the water pressure of the fire-extinguishing water running from the water inlet passage 11 through the valve port 13 to the water outlet passage 12 is regulated, so as to make the fire-extinguishing water reach preset emitting pressure.

Now please refer to FIG. 4. When the electric valve 41 or the manual valve 42 is closed, the fire-extinguishing water in the water-pressure control chamber 20 is prevented form flowing out through the water outlet manifold 15, making the water pressure in the water-pressure control chamber 20 increase. When the sum of the water pressure in the water-pressure control chamber 20 and the spring pressure of the compression spring 23 is greater than the water pressure in the water inlet pipeline 11, the valve plug 21 is driven to close the valve port 13. Then the pressure switch 71 determines whether there is fire-extinguishing water remained in the water outlet manifold 15 and activates the self-acting discharge valve 72 to discharge the fire-extinguishing water if needed.

The present invention has been described with reference to the preferred embodiments and it is understood that the embodiments are not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

The invention claimed is:

1. A valve control device for fire-extinguishing piping, the valve control device comprising:

a deluge valve defining therein a valve port as well as a water inlet passage and a water outlet passage that are both communicated with the valve port, the deluge valve also defining therein a water-pressure control chamber that is equipped with a valve plug for removably closing the valve port, and the deluge valve having a water inlet manifold that is communicated with the water inlet passage and the water-pressure control chamber, and a water outlet manifold that is communicated with the water outlet passage and the water-pressure control chamber;

an adjustable-pressure valve being installed on the water outlet manifold;

a constant-pressure valve being installed on the water outlet manifold and arranged between the water-pressure control chamber and the adjustable-pressure valve; and a switch valve being installed on the water outlet manifold and arranged between the water-pressure control chamber and the constant-pressure valve, wherein, the water inlet manifold guides fire-extinguishing water in the water inlet passage to enter the water-pressure control chamber for pressure accumulation, and the water outlet manifold guides the fire-extinguishing water in the water-pressure control chamber to be discharged into the water outlet passage that uses the switch valve to control when the fire-extinguishing water is discharged, and wherein the constant-pressure valve performs first water-pressure control on the fire-extinguishing water in the water-pressure control chamber and in the water outlet manifold, and the adjustable-pressure valve performs second water-pressure control on the fire-extinguishing water in the water-pressure control chamber and in the water outlet manifold, wherein the water outlet manifold is provided with an outlet needle valve that controls a flow of the fire-extinguishing water discharged from the water-pressure control chamber to the water outlet passage.

2. The valve control device for fire-extinguishing piping of claim 1, wherein the second water-pressure control performed by the adjustable-pressure valve is to reach a pressure that is smaller than a pressure where the first water-pressure control performed by the constant-pressure valve is to reach.

3. The valve control device for fire-extinguishing piping of claim 1, wherein the switch valve comprises an electric valve.

4. The valve control device for fire-extinguishing piping of claim 3, wherein the electric valve is an electric ball valve.

5. The valve control device for fire-extinguishing piping of claim 3, wherein the switch valve further comprises a manual valve, and the manual valve and the electric valve are connected in parallel while configured on the water outlet manifold.

6. The valve control device for fire-extinguishing piping of claim 1, wherein the water inlet manifold is provided with an inlet needle valve that controls a flow of the fire-extinguishing water entering the water-pressure control chamber through the water inlet passage.

7. The valve control device for fire-extinguishing piping of claim 6, wherein the water inlet manifold is provided with a check valve that is configured between the water inlet passage and the inlet needle valve.

8. The valve control device for fire-extinguishing piping of claim 1, wherein the water outlet manifold is provided with a stop valve that is configured between the water-pressure control chamber and the outlet needle valve.

* * * * *